US005479818A

United States Patent [19]

Walter et al.

[11] Patent Number: 5,479,818

[45] Date of Patent: Jan. 2, 1996

[54] PROCESS FOR DETECTING FOULING OF AN AXIAL COMPRESSOR

[75] Inventors: Hilger A. Walter, Stade; Herwart Hönen, Uebach-Palenberg; Heinz E. Gallus, Aachen, all of Germany

[73] Assignee: Dow Deutschland Inc., Germany

[21] Appl. No.: 246,908

[22] Filed: May 20, 1994

[51] Int. Cl.[6] ..... G01L 3/26

[52] U.S. Cl. ..... 73/116; 73/768

[58] Field of Search ..... 73/86, 168, 116; 364/506, 576

[56] References Cited

U.S. PATENT DOCUMENTS

| | | | |
|---|---|---|---|
| 3,003,970 | 10/1961 | Call | 252/152 |
| 3,132,562 | 5/1964 | Frevel | 89/1.7 |
| 3,216,244 | 11/1965 | Borchers | 73/115 |
| 3,244,006 | 4/1966 | Delmonte | 73/398 |
| 3,259,650 | 7/1966 | Decker et al. | 260/515 |
| 3,468,322 | 9/1969 | Katzer | 137/1 |
| 3,581,572 | 6/1971 | Frick | 73/406 |
| 3,679,382 | 7/1972 | Cohrs et al. | 44/7 |
| 3,820,963 | 6/1974 | Moore et al. | 44/62 |
| 3,963,367 | 6/1976 | Stalker et al. | 415/17 |
| 4,026,111 | 5/1977 | Matthews | 60/641 |
| 4,052,857 | 10/1977 | Altschuler | 60/641 |
| 4,055,994 | 11/1977 | Roslyng et al. | 73/116 |
| 4,058,015 | 11/1977 | Stode | 73/395 |
| 4,072,619 | 2/1978 | Williams et al. | 252/47.5 |
| 4,196,472 | 4/1980 | Ludwig et al. | 364/431 |

(List continued on next page.)

FOREIGN PATENT DOCUMENTS

| | | |
|---|---|---|
| 0024823 | 10/1981 | European Pat. Off. . |
| 0465696 | 3/1992 | European Pat. Off. . |
| 2248427 | 5/1975 | France . |
| 2049338 | 4/1971 | Germany . |
| 3605958 | 9/1987 | Germany . |
| 57-129297 | 8/1982 | Japan . |
| 2191606 | 12/1987 | United Kingdom . |

OTHER PUBLICATIONS

*Combustion and Flame,* vol. 25, No. 1, 1 Aug. 1975, New York, pp. 5–14.

Y. Mizutani et al., "A Study on the Structure of Premixed Turbulent Flames by the Microphone–Probe Technique", pp. 6–7.

Int'l Patent Appl. No. PCT/US93/05765, filed Jun. 16, 1993.

European Patent Appl. No. 92113607.3, filed Aug. 10, 1992.

Int'l Patent Appl. No. PCT/US93/05764, filed Jun. 16, 1993.

European Patent Appl. No. 92113586.9, filed Aug. 10, 1992.

Int'l Patent Appl. No. PCT/US93/05766, filed Jun. 16, 1993.

European Patent Appl. No. 92113606.5, filed Aug. 10, 1992.

Int'l Patent Appl. No. PCT/US93/05768, filed Jun. 16, 1993.

European Patent Appl. No. 92113585.1, filed Aug. 10, 1992.

"Fast Response Wall Pressure Measurement as a Means of Gas Turbine Blade Fault Identification", K. Nathioudakis et al., Gas Turbine & Aeroengine Congress Expo, Brussels, Belgium, Jun. 11–14 1990, ASME Paper No. 90–GT. 341.

"Rotating Waves as a Stall Inception Indication in Axial Compressors", V. H. Garnier et al., Gas Turbine & Aeroengine Congress and Expo, Brussels, Belgium ASME paper No. 90–GT–156.

Hönen, Herwart, "Experimental Studies of the Three–Dimensional Unsteady Flow Behavior in a Subsonic Axial Compressor Stage," Jun. 24, 1987.

*Primary Examiner*—Hezron E. Williams
*Assistant Examiner*—Max H. Noori
*Attorney, Agent, or Firm*—Dale H. Schultz

[57] ABSTRACT

A process and device for detecting fouling of an axial compressor by measuring of pressure fluctuations within at least one of the stages of said compressor in the region of the compressor housing by means of at least one pressure sensing device, deriving a frequency signal from the signals delivered from said pressure sensing device, checking whether each of said frequency signals comprises at least one characteristic peak in the region of a characteristic frequency assigned to one of said compressor stages, and deriving a fouling parameter from said frequency signal, which parameter depends on a peak parameter indicative of the form of said characteristic peak and indicating the status of fouling of the compressor.

44 Claims, 5 Drawing Sheets

U.S. PATENT DOCUMENTS

| | | | |
|---|---|---|---|
| 4,216,672 | 8/1980 | Henry et al. | 73/115 |
| 4,252,498 | 2/1981 | Radcliffe et al. | 415/26 |
| 4,256,511 | 3/1981 | Atchison et al. | 134/46 |
| 4,263,805 | 4/1981 | Isley et al. | 73/38 |
| 4,311,040 | 1/1982 | Long | 73/115 |
| 4,322,977 | 4/1982 | Sell et al. | 73/701 |
| 4,364,266 | 12/1982 | Williams | 73/115 |
| 4,414,817 | 11/1983 | Jernigan | 60/641.2 |
| 4,422,125 | 12/1983 | Antonazzi et al. | 361/283 |
| 4,422,333 | 12/1983 | Leon | 73/660 |
| 4,422,335 | 12/1983 | Ohnesorge et al. | 73/724 |
| 4,434,664 | 3/1984 | Antonazzi et al. | 73/701 |
| 4,449,409 | 5/1984 | Antonazzi | 73/724 |
| 4,457,179 | 7/1984 | Antonazzi et al. | 73/701 |
| 4,500,500 | 2/1985 | Paalman et al. | 423/224 |
| 4,528,817 | 7/1985 | Jernigan | 60/641.2 |
| 4,604,702 | 8/1986 | Zwicke | 364/431.02 |
| 4,618,856 | 10/1986 | Antonazzi | 340/626 |
| 4,625,280 | 11/1986 | Couch | 364/431.02 |
| 4,629,608 | 12/1986 | Lampton, Jr. et al. | 423/226 |
| 4,648,711 | 3/1987 | Zachary | 356/44 |
| 4,808,235 | 2/1989 | Woodson et al. | 134/22.19 |
| 4,902,563 | 2/1990 | McCullough, Jr. et al. | 428/284 |
| 4,921,683 | 5/1990 | Bedell | 423/235 |
| 4,926,620 | 5/1990 | Donle | 55/89 |
| 4,978,571 | 12/1990 | McCullough, Jr. et al. | 428/263 |
| 4,989,159 | 1/1991 | Liszka et al. | 364/508 |
| 4,995,915 | 2/1991 | Sewell et al. | 134/22.14 |
| 5,165,845 | 11/1992 | Khalid | 415/17 |
| 5,235,524 | 8/1993 | Barkhoudarian et al. | 364/506 |

$A_{max}$
70
72
AMPLITUDE OF FREQUENCY SIGNAL
$\nu_1$ $\nu_C$ $\nu_2$
FREQUENCY

70a
AMPLITUDE OF FREQUENCY SIGNAL
$\nu_{LL}$ $\nu_C$ $\nu_{UL}$
FREQUENCY

70b
AMPLITUDE OF FREQUENCY SIGNAL
$\nu_{LL}$ $\nu_C$ $\nu_{UL}$
FREQUENCY

70c
AMPLITUDE OF FREQUENCY SIGNAL
$\nu_{LL}$ $\nu_C$ $\nu_{UL}$
FREQUENCY

PROCESS FOR DETECTING FOULING OF AN AXIAL COMPRESSOR

CROSS-REFERENCE TO RELATED APPLICATION

This application is a continuation-in-part application of International Patent Application No. PCT/US93/05765 which was filed on Jun. 16, 1993, and which designates the United States of America, and which claims International Priority from European Patent Application No. 92113607.3 which was filed on Aug. 10, 1992.

FIELD OF THE INVENTION

The present invention relates to a process and a device for detecting fouling of an axial compressor, said compressor comprising a rotor and a housing, said rotor being rotatably mounted within said housing for rotation about a rotational axis with variable or constant rotational speed, said compressor further comprising at least one compressor stage, each of said at least one stages comprising a row of rotor blades mounted on said rotor and being arranged one following the other in a circumferential direction with respect to said rotational axis and of a row of stator blades mounted on said housing and being arranged one following the other in a circumferential direction with respect to said rotational axis.

The invention provides for a detection of fouling of either multi- or single stage compressors. The compressor may be operated as an isolated unit or in conjunction with a power turbine engine, as would be the case in a power plant operation. The compressor may further be part of a gas turbine used for driving aeroplanes, ships or large vehicles.

BACKGROUND OF THE INVENTION

Compressors exist of a series of rotating or stationary blade rows in which the combination of a rotor (circular rotating blade row) and a stator (circular stationary blade row) forms one stage. Inside the rotor, kinetic energy is transferred to the gas flow (usually air) by the individual airfoil blades. In the following stator, this energy is manifested as a pressure rise in the gaseous air as a consequence of deceleration of the gaseous air flow. This deceleration of the gaseous air flow is induced as a result of the design of the stator section. The pressure ratio (exit pressure/inlet pressure) of a single stage is limited because of intrinsic aerodynamic factors, so several stages are connected together in many turbo compressors to achieve higher pressure ratios than could be achieved by a single stage.

When operating an axial compressor, the problem of "fouling" arises, namely the continuous contamination of the surfaces of the rotor and stator blades with oil and dust, particularly of the first compressor stages at the inlet of the compressor.

In an initial phase of the fouling problem, an increased surface roughness of the blades may be observed, influencing the behavior of the boundary layer air associated with the blades. The air fluid flow around each blade has an associated flow boundary layer which covers each blade and coheres to the blade. The flow boundary layer associated with a rotor blade will rotate as an associated entity of the blade as the blade itself rotates. At the downstream edge of each blade, this flow boundary layer melds into an associated flow boundary entity known as, alternatively, the Dellenregion, wake region, or delve region which is characterized by a localized reduction in both pressure and flow velocity. As in the case of the flow boundary layer, the associated wake region rotates with its rotor blade. As the contamination collects on the blade over a period of time, the resultant surface roughness also increases, which causes the thickness of the flow boundary layer also to increase. As a result, the wake region becomes more and more extensive and pronounced. Therefore, increasing thickness of the boundary layer will produce higher losses of the total pressure throughout the bladings, leading to efficiency reduction of the compressor.

Axial compressors therefore are "washed" after certain operation intervals by cleaning the blades of at least the front stages.

The time interval between successive cleaning operation should not be too long, as otherwise the compressor is operated with too much reduced efficiency. Under certain circumstances, the danger of compressor stall or compressor surge increases. Due to the reduced efficiency, the compressor load has to be increased (operating point moves closer to stability line) to maintain the outlet pressure.

On the other hand, it is quite uneconomical when the compressor is cleaned after a relatively short operation period, particularly as the cleaning leads to a distinct operational interruption.

Therefore, it is desirable to measure the actual fouling state of the compressor, in order to determine the optimum time for said "washing".

Contemporary turbo engines are usually equipped with fuel or energy control systems which measure and output a variety of operating parameters for the overall engine. Included in such control systems are highly accurate pressure sensing devices or systems. For example, pressure measuring systems are described in U.S. Pat. No. 4,322,977 entitled "Pressure Measuring System" filed May 27, 1980 in the names of Robert C. Sell, et al; U.S. Pat. No. 4,434,664 issued Mar. 6, 1984, entitled "Pressure Ratio Measurement System", in the names of Frank J. Antonazzi, et al.; U.S. Pat. No. 4,422,335 issued Dec. 27, 1983, entitled "Pressure Transducer" to Ohnesorge, et al.; U.S. Pat. No. 4,449,409, issued May 22, 1984, entitled "Pressure Measurement System With A Constant Settlement Time" in the name of Frank J. Antonazzi; U.S. Pat. No. 4,457,179, issued Jul. 3, 1984, entitled "Differential Pressure Measuring System", in the names of [J Bluish] Frank J. Antonazzi, et al.; and U.S. Pat. No. 4,422,125 issued Dec. 20, 1983, entitled "Pressure Transducer With An Invariable Reference Capacitor", in the names of Frank J. Antonazzi, et al.

While a wide variety of pressure measuring devices can be used in conjunction with the present invention, the disclosures of the above-identified patents and the article mentioned next are hereby expressly incorporated by reference herein for a full and complete understanding of the operation of the invention.

As initially mentioned, the efficiency of said axial compressor depends on the fouling state thereof. On line derivation of the efficiency of said compressor, however, is only an indirect indicator of the fouling status and cannot be used to derive direct conclusions concerning the state of fouling; there also are many other parameters influencing the characteristics of the flowing air in the high pressure stages of said compressor and the efficiency of those stages, and those other parameters are difficult to measure.

The article "Fast Response Wall Pressure Measurement as a Means of Gas Turbine Blade Fault Identification" by K. Mathioudakis et al as presented at the "Gas Turbine and Aeroengine Congress and Exposition" from Jun. 11–19, 1990, Brussels, Belgium, ASME Paper No. 90-GT-341, relates to the identification of blade faults. For simulating fouling of the rotor, all blades of one rotor of the compressor were coated with a textured paint, said paint layer roughening the surface and causing a slight alteration of the contour of the blades. The dynamic pressure field around the rotor was measured by fast response pressure transducers at the inner circumferential surface of the rotor housing. From the time depending pressure sensor signals, respective frequency signals (power spectra) were derived and compared with respective frequency signals of an intact compressor (without blade painting). Respective tests were performed for other blade faults, as there are bended or twisted blades, rotors with only two faulty blades (simulated by painting only these two blades). The latter faults could be more or less clearly identified from comparison of the respective power spectra. To this aim, certain indices were derived from the power spectra to be compared, namely the ratio of spectra amplitudes and the logarithm thereof. These tests show that a discrimination of the mentioned test faults is principally possible, for which complex simulation- calculations have to be performed.

This article does not deal with the problem of an actual determination of one blade fault, namely of blade fouling. The experimental setup with painting of all rotor blades is only a rough simulation of the actual fouling process, which is characterized by a more subtle increase of surface roughness of the blades during the operation time of the compressor.

SUMMARY OF THE INVENTION

It is an object of the present invention to provide a process for detecting fouling of an axial compressor which allows the monitoring of fouling.

It is a further object of this invention to provide a process for detecting fouling of an axial compressor which allows the determination of an optimum time for "washing".

Another object of the invention is to provide a process for detecting fouling of an axial compressor allowing an online monitoring, using common calculation techniques for the signal evaluation.

One or more of these objects are solved by the process according to the invention, said process comprising the following steps:

a) measuring of pressure fluctuations within at least one of said compressor stages in the region of said housing by means of at least one pressure sensing device, each device delivering a sensor signal, respectively;

b) deriving a frequency signal from each of said sensor signals, said frequency signal being indicative of amplitudes of frequency components of said respective sensor signals in a respective frequency interval;

c) checking whether each of said frequency signals comprises at least one characteristic peak in a region of a characteristic frequency assigned to one of said compressor stages, indicative of the form of said characteristic peaks, said characteristic frequency being defined as the product of said rotational speed and the blade number of the rotor blades of the respective compressor stage;

d) deriving a fouling parameter from said frequency signal, said fouling parameter depending on a peak parameter, said peak parameter being indicative of the form of said characteristic peak.

According to the invention, a characteristic peak is observed. This peak is sensitive to changes in the flow conditions. When the compressor is operating, the wake regions of the rotating blades, passing the pressure sensing device, produce a pressure variation at the pressure sensing device with the characteristic frequency. The frequency signal derived from the respective sensor signal shows a respective characteristic peak, the form of which is defined by respective peak parameters (peak height, peak width or the like). It was found that, with increasing fouling of the rotor stage, the respective characteristic peak becomes more distinct (increasing height and width) which may be attributed to the wake regions increasing with fouling. Only one single parameter, that is the fouling parameter, has to be calculated and monitored.

The pressure fluctuations due to the wake regions of the rotating blades can be measured best by said pressure sensing device being arranged at said housing between the rotor blades and the stator blades of the respective compressor stage. An example of a pressure measuring system is described in PCT Publication (with International Publication Number WO 94/03785 filed Jun. 16, 1993 and published Feb. 17, 1994) titled ADAPTOR FOR MOUNTING A PRESSURE SENSOR TO A GAS TURBINE HOUSING. This publication is hereby expressly incorporated herein by reference for the purpose of showing a preferred pressure measuring system for use in the invention It is preferred that the at least one pressure sensing device be located near the low pressure end of said axial compressor. The pressure sensing device thus is most sensitive for the first compressor stages which primarily are subject to fouling. Principally, the characteristic peak of for example, the first stage, may also be measured at another stage if the characteristic frequencies are different; however, the peak amplitude measured will be lower.

For the process according to the invention, only the time varying part of the absolute pressure is of interest. These pressure fluctuations may be directly measured by means of a piezoelectric or piezoresistive pressure sensor, especially a piezocapacitive pressure sensor. Another less preferred pressure sensing device is a strain gauge pressure sensor.

The frequency signal may easily be derived from the detector signals by using common evaluation techniques, for example fast Fourier transformation (FFT) or fast Hartley transformation (FHT). No model calculations are necessary. The respective electronic transformation units are readily obtainable.

The peak parameter indicative of the form of the characteristic peak may be the peak height or the peak width. In both cases, the parameter is easy to determine and easy to be compared with a limit value or with the limits of an allowed region.

In order to enhance the accuracy and/or to reduce the evaluation efforts, the frequency interval in which the frequency signal has to be evaluated, is determined to have a reduced width of less than 4000 Hz. A preferred width is 2000 Hz so that the frequency signal has to be evaluated only between the characteristic frequency minus 1000 Hz and the characteristic frequency plus 1000 Hz.

In order to enhance the reliability of the fouling detection according to the invention, it is proposed to divide the parameter of the characteristic peak by an operating parameter indicative of the operating condition of said compressor, this quotient defining the fouling parameter. The peak parameter not only depends on the fouling status of the compressor, but also on the respective operating condition of the compressor. In essential, the fouling parameter, as defined, is independent of the operating condition of the compressor.

The choice of the operating parameter depends on the kind of control of the axial compressor. In case of T44-control (constant air temperature at a certain point of the compressor turbine entity, namely the low pressure turbine inlet), it is preferred to use the measured power output of the compressor as operating parameter.

In a preferred embodiment of the invention, a status change signal indicative of a change of the operational status of the compressor, is generated in case of said fouling parameter having a value lying beyond a determined value range.

An alternative embodiment of the invention solving one or more of the above mentioned objects, comprises the following steps:

a) measuring of pressure fluctuations within at least one of said compressor stages in the region of said housing by means of at least one pressure sensing device, each device delivering a sensor signal, respectively;

b) deriving a frequency signal from each of said sensor signals, said frequency signal being indicative of amplitudes of frequency components of said respective sensor signals in a respective frequency interval;

c) deriving a fouling parameter from said frequency signal, said fouling parameter depending on an integral value of said frequency signal, said integral value being defined as an integral of said frequency signal over a predetermined integration interval.

It was found that not only the characteristic peak, but also the whole frequency spectrum is influenced by compressor fouling. This phenomenon supposedly is due to the flow perturbation in the stages successive to that stage with blade fouling. The perturbed successive stages in turn disturb the flow conditions of the preceding stages so that the noise level of the frequency spectrum, measured at, for example the first stage, is respectively increased. The integral value of the frequency signal is obtained by simple calculation. The monitoring of fouling may be performed easily, since only one single parameter, namely the fouling parameter, is to be observed.

It is preferred that the frequency interval equals the integration interval. Thus, the whole frequency spectrum is taken into consideration.

In order to compensate for changing operating conditions, the fouling parameter may be defined as the integral value divided by an operating parameter. Preferably, said operating parameter is indicative of the power output of the compressor.

The invention further relates to a device for detecting fouling of an axial compressor in accordance with the above described process for detecting fouling of an axial compressor by determining at least one peak parameter signal indicative of the form of a characteristic peak. The invention also relates to a device for detecting fouling of an axial compressor in accordance with the above described process, determining an integral value signal by integrating the frequency signal over a predetermined frequency interval.

BRIEF DESCRIPTION OF THE DRAWINGS

For a better understanding of the invention, reference is made to the following description and the drawings.

DESCRIPTION OF THE PREFERRED EMBODIMENT

Figure 1:
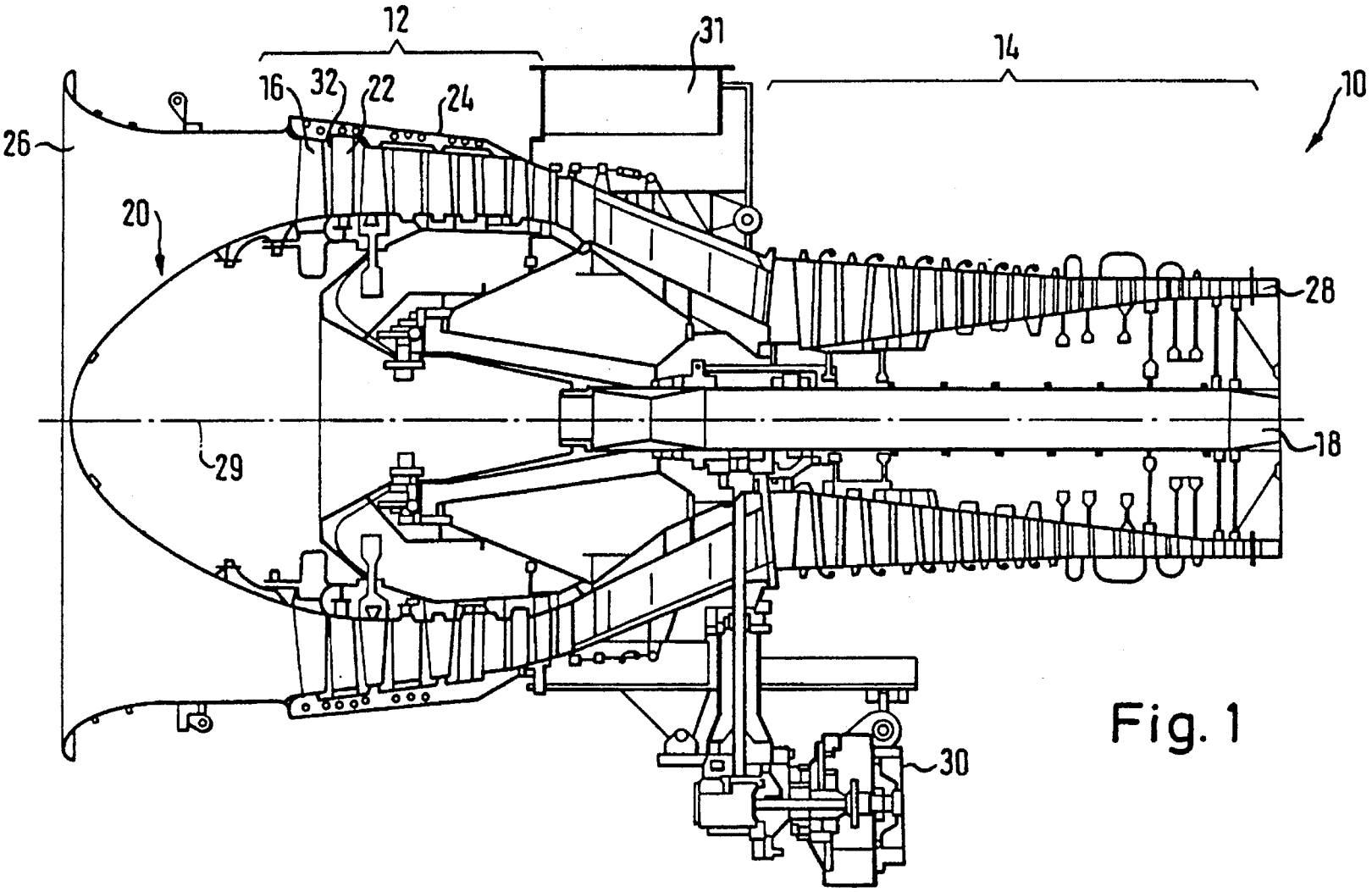
FIG. 1 is a simplified graphic representation of an axial compressor as part of a gas turbine showing the location of a dynamic pressure probe.
Figure 2:
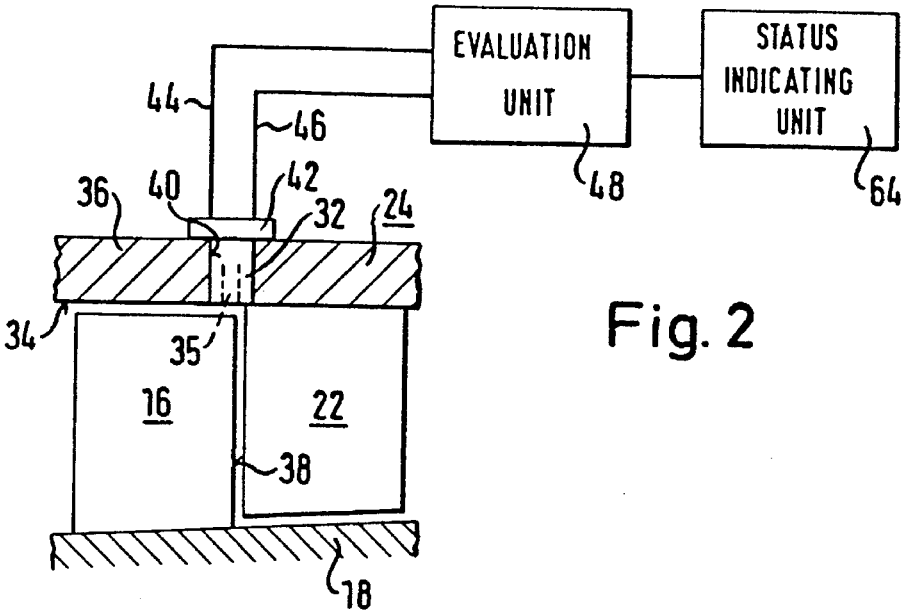
FIG. 2 is a schematic representation of the compressor of FIG. 1 illustrating the first compressor stage at the low pressure end of the compressor.

Referring to the drawings, wherein equal numerals correspond to equal elements throughout, first reference is made to FIGS. 1 and 2 wherein a typical compressor part of a gas turbine engine is depicted (including the present invention). The compressor 10 is comprised of a low pressure part 12 and a high pressure part 14. Rotor blades 16 of the compressor are mounted on a shaft 18 of a rotor 20. Stator blades 22 (guide vanes) are mounted in a housing (casing) 24 of said compressor 10 and are therefore stationary. Air enters at an inlet 26 of the gas turbine engine and is transported axially to following compressor stages of the compressor under increasing pressure to an outlet 28. An axis 30 of said compressor is defined as the axis of rotation of the rotor 20.

Each of the mentioned compressor stages consists of two rows of blades with equal blade number, namely a row of rotor blades 16 and a row of stator blades 22. The blades of each row are arranged one following the other in a circumferential direction with respect to said axis 30. FIG. 2 shows the first compressor stage of the compressor at its inlet 26 (low pressure axial end of the compressor) with rotor blades 16 and stator blades 22. The compressor 10, according to FIG. 1, comprises an accessory gear box 30 enabling the adjustment of orientation of blades in order to change the load of the respective stages. FIG. 1 further shows a bleed air collector 31 between the low pressure part 12 and the high pressure part 14. As the compressor, used in connection with the invention, is of common construction, it is not necessary to go into further detail.

According to the invention, a pressure sensing device in form of a dynamic pressure sensor 32 is mounted in the axial gap between the rotor blades 16 and the stator blades 22 of the first stage in the low pressure part of the compressor 10 nearest to the inlet 26 of compressor 10. An inlet opening 35 of the sensor 32 is flush with an inner circumferential surface 34 of a wall 36 defining said housing 24. Thus, sensor 32 measures the pressure fluctuations of the first stage, occurring at the inner circumferential face 34. Since the sensor 32 is located in the region of the axial gap between the row of rotor blades 16 and stator blades 22, following the rotor blades downstream, the sensor 32 is sensitive for the so called wake regions (Dellenregionen) being developed by the axial air flow at the downstream edge 38 of each rotary blade. These wake regions rotating with the respective rotary blade 16, are regions with lower density and flow velocity and with varying flow direction.

Instead of directly mounting the sensor 32 in an opening 40 (borescope hole), it is also possible to use an elongated adaptor (not shown) which, with one of its ends, is mounted to the opening 40 and, at its other end, carries the sensor.

The illustrated location of the sensor 32 at the low pressure axial end of the low pressure part 12 of the compressor 10 is preferred, because the amount of fouling occurring during the operational time of an axial compressor in a stage near the inlet 26 of the compressor 10, is higher than the amount of fouling in stages downstream of the first stage. Further, the disturbance of the pressure fluctuations, used for determining the amount of fouling of a compressor, which are caused by pressure fluctuations in other stages, show the least influence on the characteristic peak (described later on) of the pressure signal detected in the stages near the inlet 26. Although not illustrated, further pressure sensors may be located in stages following the first stage downstream to obtain additional information about the amount of fouling in these other stages. Dynamic pressure sensors, preferably piezoelectric pressure sensors, are used because of their reliability, high temperature operability and sensitivity for high frequency pressure fluctuations up to 20000 Hz (for example Kistler Pressure Sensor, Type 6031).

Figure 3:
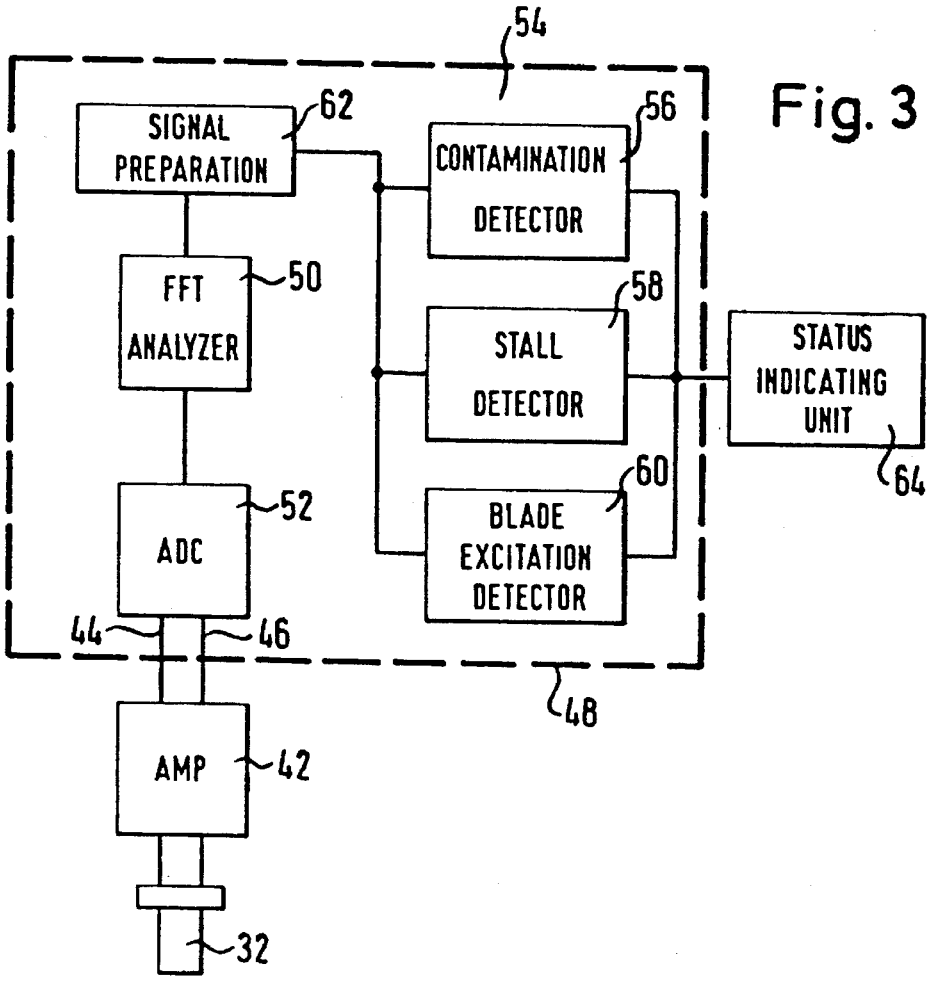
FIG. 3 is a block diagram of the dynamic pressure probe connected to an evaluation unit.

As shown in FIGS. 2 and 3, the sensor is provided with an amplifier 42, amplifying the respective sensor signal. The amplifier 42 is connected via lines 44,46 to an evaluation unit 48.

As shown in FIG. 3, the evaluation unit 48 contains a fast Fourier transformer (FFT) analyzer 50 which receives signals from amplifier 42 through an analog digital converter ADC (or multiplexer) 52 which is connected between the amplifier 42 and the FFT analyzer 50.

A general parts and components list for making, installing, and using the present invention is presented in Table 1. The vendor identifier in Table 1 references the information given in Table 2, which identifies the vendor's address for each vendor identifier.

TABLE 1

| Description | | Vendor |
|---|---|---|
| Dyn.press sensor | 6031 | KIST |
| Dyn.press sensor | 6001 | KIST |
| Mounting nuts and conn.nipples | 6421 | KIST |
| Mounting nuts and conn.nipples | 6421 | KIST |
| Mounting nuts | 6423 | KIST |
| Kable | 1951A0.4 | KIST |
| Kable | 1631C10 | KIST |
| Amplifier | Y5007 | KIST |
| Isolation transformer | T4948 | HAUF |
| Multipair twistet cable | | |
| Vibration pick up | 306A06 | PCB |
| Kable | 1631C10 | KIST |
| Transducer 12 channel | F483B03 | PCB |
| CRF-Vib signal 0–10 V | VIBR | |
| Low press Rotor speed | | GE |
| High press Rotor speed | | GE |
| Isolation Aplifier | EMA U-U | WEID |
| Centronics connector | 116776 | WEID |
| Relay | | |
| Industrial computer | BC24 | ACTI |
| CPU 80386/20 Mhz | | |
| Math coprocessor 80387 | | |
| RAM = 1 MB | | |
| 20 MB HD | | |
| EGA | | |
| Power supply 28 V DC | | |

TABLE 1-continued

| Description | | Vendor |
|---|---|---|
| 5 free 16 Bit Slots/AT-Bus | | |
| DOW 3.3 | | |
| Spectral Analyser | V5.x | STAC |
| LAN Network board | 3C501 | 3COM |
| 2 MB RAM/ROM Board | | DIGI |
| EGA Monitor 14" | | |
| Keybord for AT-PC | | |
| Instrument Rack | | KNUR |
| VMS Operating System | | DEC |
| Operator Interface and General Purpose Computer | | |
| Microvax 11 Computer with 9 MB, RAM, hard disk drive of 650 megabytes storage capacity | | DEC |
| TEK H207 monitor | | TEK |

TABLE 2

| Vendor | Address |
|---|---|
| ACTI | ACTION Instruments, Inc.<br>8601 Aero Drive<br>San Diego<br>CA 92123 USA |
| DIGI | Digitec Engineering GmbH<br>D-4005 Meerbusch, Germany |
| GE | General Electric Co.<br>1 Neumann Way<br>Mail Drop N-155<br>US Cincinnati OHIO |
| KIST | Kistler Instrumente GmbH<br>Friedrich-List-Strasse 29<br>D-73760 Ostfildern, Germany |
| KNUR | Knuerr AG<br>Schatzbogen 29<br>D-8000 Meunchen 82, Germany |
| PCB | PCB Piezotronics Inc.<br>3425 Walden Avenue<br>Depew<br>New York |
| VIBR | Vibro meter SA<br>Post Box 1071<br>CH-1701 Fribourg, Germany |
| WEID | Weidmueller GmbH & Co.<br>PF 3030<br>D-4930 Detmold, Germany |
| DEC | DIGITAL Equipment Corp.<br>Maymond, Massachusetts |
| TEK | Tektronics Corp.<br>P.O. Box 1000<br>Wilsonville, Oregon 97070-1000 |

The signals from the FFT analyzer are transmitted to a computer unit 54, comprising several subunits, amongst them a contamination detector 56. Besides this contamination detector 56, further detectors for the status of the compressor may be installed, for example a stall detector 58 for monitoring the operational status of the compressor 10 and a blade excitation detector 60 for detecting pressure fluctuations which are able to induce high amplitude blade vibrations, which may damage the compressor. However, the fouling detection according to the present invention, may also be performed independently of stall detection and blade excitation detection.

In order to facilitate the computing of the frequency signals output from the FFT analyzer 50, a unit 62 for signal preparation may be connected between the FFT- analyzer 50 and the detectors 56, 58, 60. The unit 62 contains filter algorithms for handling and smoothing digital data as received from the FFT analyzer. The resulting frequency signals from the FFT analyzer, after smoothing via unit 62, are forwarded to said detectors 56,58,60 for comparison with respective reference patterns. If the comparison analyzers indicate deviations beyond a predetermined allowable threshold of difference, the computed evaluation is transmitted to a status indicating unit 64 to indicate contamination or stall or blade excitation. Thus, the operation and status of compressor 10 can be monitored.

In detectors 56, 58, 60, the smoothed frequency signal is evaluated, said frequency signal being indicative of the amplitudes of frequency components of the respective sensor signal in a respective frequency interval. The contamination detector 56 examines the frequency signals in a specific frequency region around a specific frequency, the so called characteristic frequency C, said characteristic frequency C being defined as the product of the present rotational speed n of rotor 20 and the blade number z of the rotor blades of the respective compressor stage:

$$C=n*z$$

Figure 5A:
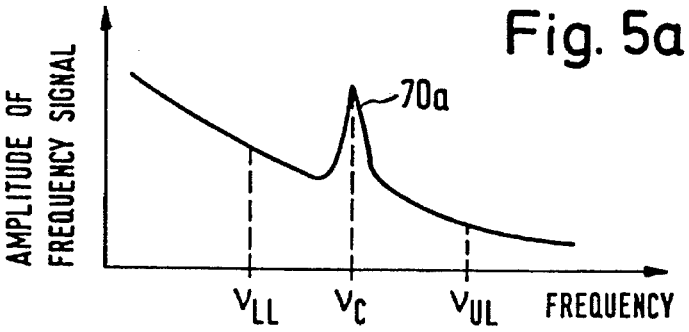
FIGS. 5*a*, 5*b*,5*c*, show three successive forms of the characteristic peak of FIG. 4 obtained with increasing fouling, starting with FIG. 5*a;*
Figure 5B:
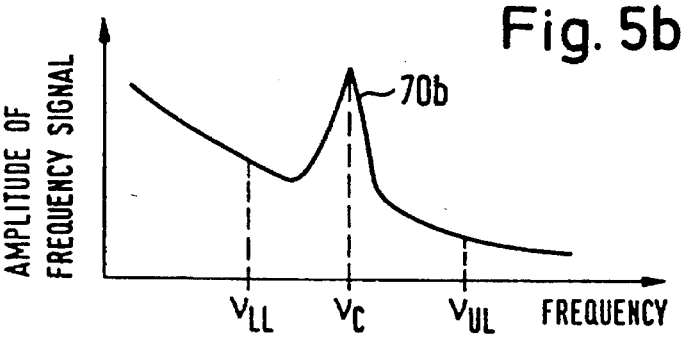

The frequency interval around C may have a width of less than 4000 Hz and preferably is 2000 Hz, so that the upper limit UL may be C 1000 Hz and the lower limit LL may be C−1000 Hz (see FIG. 5). In general, the blade number of rotor blades equals the blade number of stator blades within the same stage.

The wake regions, rotating with rotor blades 16 of the respective compressor stage, are passing the sensor 32 with the characteristic frequency C. Therefore, the frequency signal shows a respective characteristic peak 70 at c. It was found that the form of the characteristic peak varies in a characteristic manner if fouling of the respective stage increases, starting from a point after cleaning of the compressor. The peak becomes more characteristic as shown in FIG. **5*b* (peak 70*b*). Both, the peak height and the peak width increase. This behavior is due to an increase of the wake regions (Dellenregionen) of the rotating blades, producing more characteristic pressure variations with the characteristic frequency at the location of sensor 32**.

Figure 4:
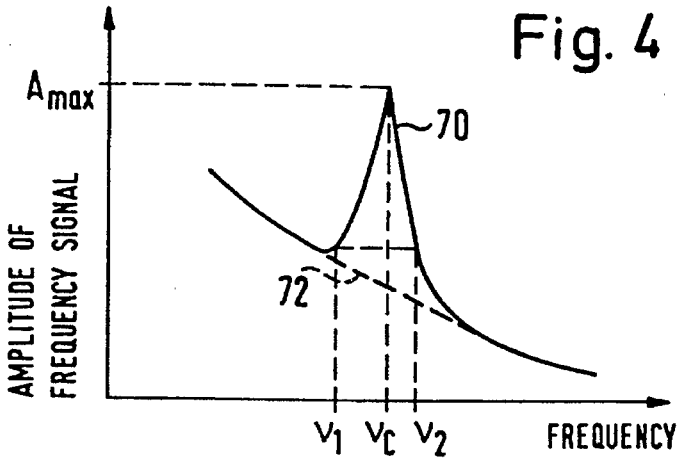
FIG. 4 illustrates a frequency signal with a characteristic peak.
Figure 5C:
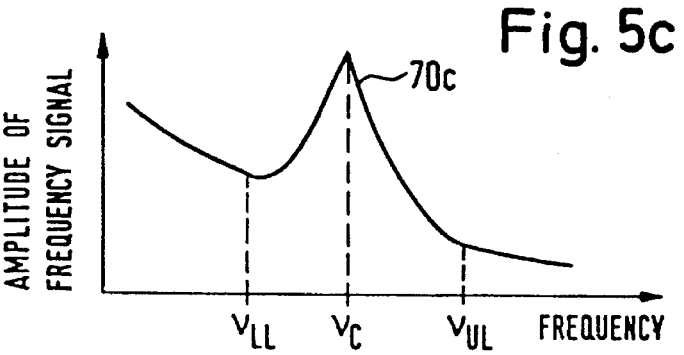

A further increase of fouling leads to a further increase of the characteristic peak in height and width (peak **70*c* in FIG. 5*c*). Thus, the observation of the characteristic peak is a sensitive tool for detecting the amount of fouling of a respective compressor stage. One possibility of detecting changes of the form of the characteristic peak 70 would be a comparison of a predetermined peak form by means of pattern recognition. However, the evaluation is simplified, if not the complete peak form, but only one peak parameter, is observed and compared with limit values. This peak parameter may be defined as peak height amax above the background line 72 or the peak width 2-1 as shown in FIG. 4**.

Figure 6:
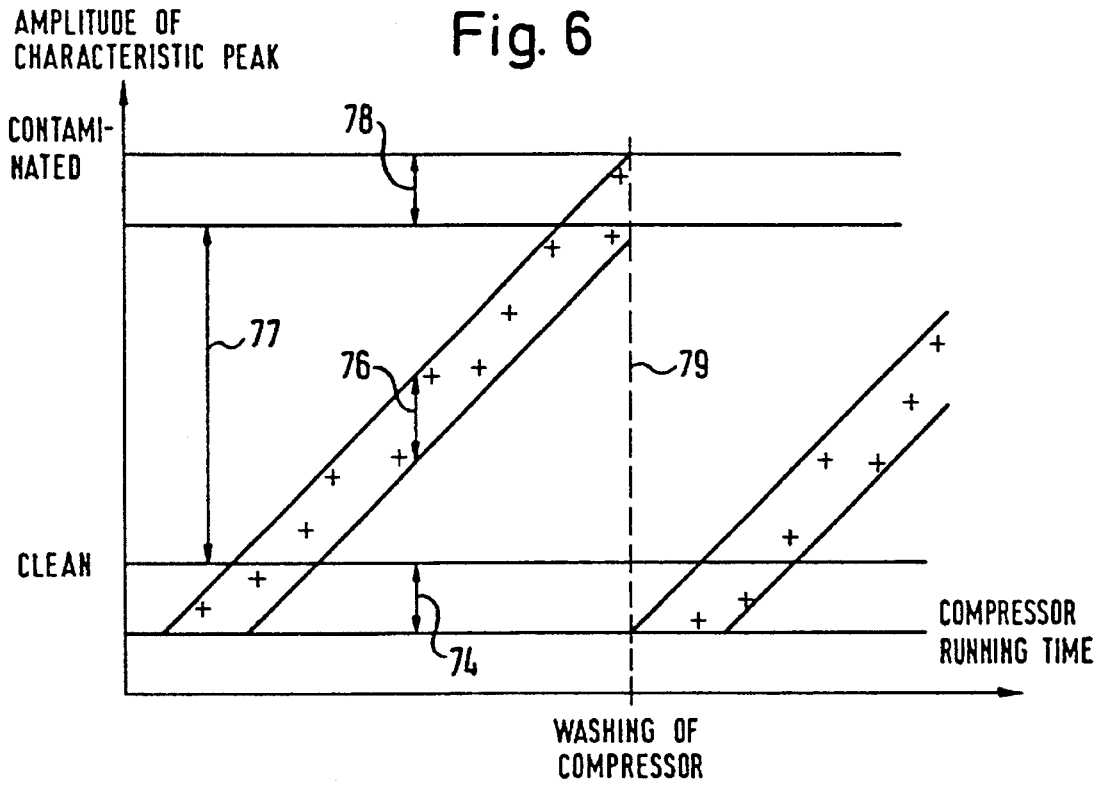
FIG. 6 shows the development of the amplitude of the characteristic peak as a function of the compressor running time.

FIG. 6 shows the development of the amplitude of a characteristic peak as a function of the compressor running time. In this diagram, a first variation range 74 is determined. When the amplitude of the characteristic peak lies within said range 74, the compressor is defined clean. Beginning with the time after the compressor has been cleaned, the compressor, an increase of the amplitude of the characteristic peak is to be observed, whereby the amplitudes of said characteristic peak, measured at respective times, lie within an inclined variation band 76 within a second variation range 77. If, with continuous compressor running time, a third range 78 is reached, the compressor condition is rated contaminated. This state does not allow an efficient compressor operation and the compressor has to be cleaned. After cleaning (dashed line 79), the amplitude of the characteristic peak again lies within the first variation range 74.

Figure 7:
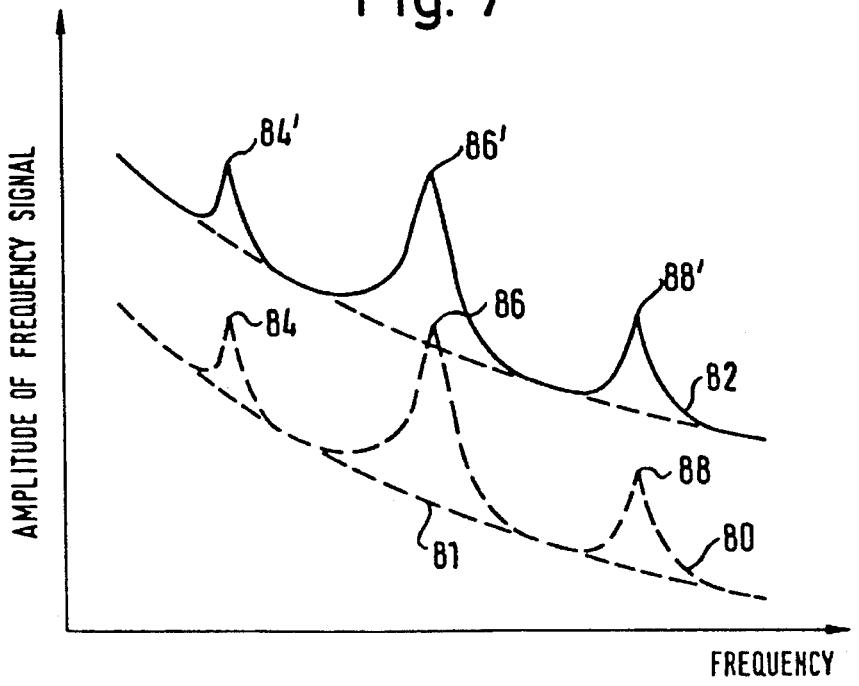
FIG. 7 shows the shift of the frequency signal with fouling.

With increasing compressor running time, it is also observed that, besides the above mentioned variation of the form of the characteristic peak, the noise level of the complete frequency signal is shifted to higher values. In FIG. 7 a first frequency signal 80 is depicted (dashed curve), obtained after cleaning the compressor. This signal 80 shows characteristic peaks 84, 86, 88 above a certain base line 81, representing the frequency dependent noise components of the frequency signal. The characteristic peaks correspond to different stages (with different blade numbers). FIG. 7 further shows a second frequency signal 82, obtained from the same pressure sensing device as in case of signal 80, but after running of the compressor for a certain running time after washing. Signal 82 is shifted upwards, relative to signal 80, maintaining the function's general form.

This shift is due to an overall increase of the frequency dependent noise components of the frequency signal. This shift may be calculated as the difference (area D in FIG. 7) of respective integral values of the signals 80 and 82, where the integral value is defined as the integral of the respective frequency signal over the entire frequency interval of this signal. The difference between the integral value of the frequency signal 80 and the integral value of the frequency signal 82, thus enables to determine the fouling condition of the compressor.

In case that with continuous compressor running time the integral value reaches a threshold corresponding to the third range 78 in FIG. 6, the compressor condition is rated as contaminated and the compressor has to be cleaned in order to allow an efficient operation thereof.

However, the value of the integral, calculated during compressor operation, further depends on the operational condition of the compressor. Thus, for being able to determine the fouling condition of the compressor, independent of the operational condition thereof' the integral value has to be related to an operating parameter of said compressor. Said operating parameter is indicative of the operating condition of the compressor and may, for example, be the power output of said compressor.

Figure 8:
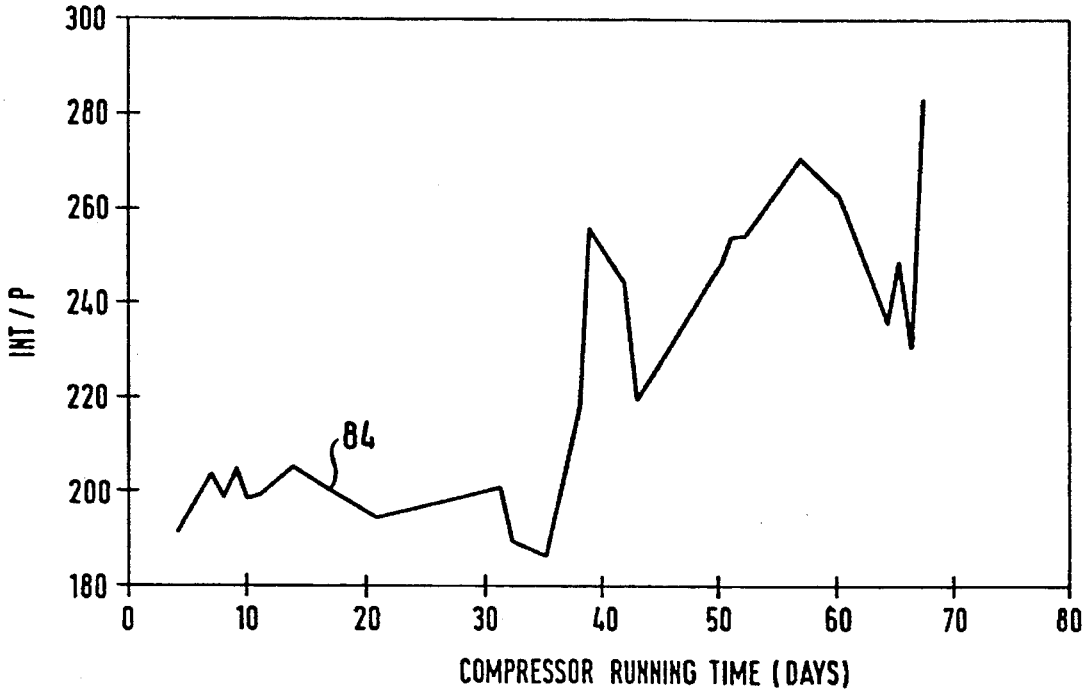
FIG. 8 shows the development of the integral value of the frequency signal divided by the power output of the compressor as a function of the compressor running time.

In FIG. 8, the integral value, related to the power output of the compressor, is shown as a function of the compressor running time. Setting out from a time after having cleaned the compressor, the curve 84 firstly shows a relatively constant integral value, divided by the power output of the compressor. With increasing compressor running time (in the case of the example, after an operational period of 30 days), a distinct increase of this quotient is to be observed, thus indicating an increasing amount of fouling of the compressor. According to the third range 78 in FIG. 6, a threshold value may be set (for example 280 in the arbitrary units of this diagram). After exceeding this value, in order to obtain an efficient operation of the compressor, at least the most contaminated stages of the compressor have to be cleaned.

Thus, the observation of the development of the characteristic peak or/and the development of the integral value, give a sensitive tool for determining the fouling condition of the compressor. By comparing these parameters to the operational status, an observation independent of the operational status can be achieved.

The present invention has been described in an illustrative manner. In this regard, it is evident that those skilled in the art, once given the benefit of the foregoing disclosure, may now make modifications to the specific embodiments described herein without departing from the spirit of the present invention. Such modifications are to be considered within the scope of the present invention which is limited solely by the scope and spirit of the appended claims.

What is claimed is:

1. Process for detecting fouling of an axial compressor, said compressor comprising a rotor, a housing, an inlet where, in operation, gas enters at a first pressure, and an outlet where, in operation, gas exits at a second pressure higher than said first pressure, said rotor being rotatably mounted within said housing for rotation about a rotational axis, said axial compressor further comprising at least one axial compressor stage, each said axial compressor stage comprising a row of rotor blades mounted on said rotor and being arranged one following the other in a circumferential direction with respect to said rotational axis, and a row of stator blades mounted on said housing and being arranged one following the other in a circumferential direction with respect to said rotational axis, each said axial compressor stage having, in operation, a dynamic pressure field surrounding each said rotor in the region of said housing, each said axial compressor stage further having, in operation, a characteristic frequency defined as the product of the number of rotor blades mounted in said row of rotor blades and the rotational speed of said rotor, each said axial compressor stage further having a defined reference pattern associated with said characteristic frequency, said process comprising the following steps:

measuring the pressure fluctuations of at least one said dynamic pressure field with a pressure sensing means responsive at said characteristic frequency and generating at least one sensor signal;

deriving a plurality of frequency components from each sensor signal, wherein one said frequency component is derived at a frequency essentially equivalent to said characteristic frequency;

smoothing said plurality of frequency components into a smoothed frequency signal; and comparing said smoothed frequency signal and said defined reference pattern, thereby determining a fouling parameter indicative of the fouling of said axial compressor.

2. Process according to claim 1, wherein said pressure sensing means is connected to said housing between the rotor blades and the stator blades of one of said axial compressor stages.

3. Process according to claim 1, wherein said pressure sensing means is connected to said housing near the inlet of said axial compressor.

4. Process according to claim 1, wherein said pressure sensing means comprises a piezoelectric pressure sensor.

5. Process according to claim 1, wherein said plurality of frequency components are derived by fast Fourier transformation (FFT).

6. Process according to claim 1, wherein said plurality of frequency components are derived by fast Hartley transformation (FHT).

7. Process according to claim 1, wherein said defined reference pattern is further characterized to comparatively relate to the height of said smoothed frequency signal.

8. Process according to claim 7, wherein said defined reference pattern is further characterized to comparatively relate to the ratio of a difference of a maximum value among said plurality of frequency components in the frequency region proximate to said characteristic frequency and a mean value among said plurality of frequency components to said mean value.

9. Process according to claim 1, wherein said defined reference pattern is further characterized to comparatively relate to the width of a peak formed by said smoothed frequency signal.

10. Process according to claim 9, wherein said width of a peak formed by said smoothed frequency signal is defined at a location within said peak which is halfway between the lowest value of said peak and the maximum value of said peak.

11. Process according to claim 1, wherein said plurality of frequency components are derived from within a predetermined frequency interval, said predetermined frequency interval having a width not greater than 4000 Hz.

12. Process according to claim 11, wherein said predetermined frequency interval has a width not greater than 2000 Hz.

13. Process according to claim 1, wherein said fouling parameter is defined from said smoothed frequency signal wherein said smoothed frequency signal is divided by an operating parameter indicative of the operating condition of said axial compressor.

14. Process according to claim 13, wherein said operating parameter is indicative of the power output of the axial compressor.

15. Process according to claim 1, wherein a status change signal indicative of a change of operational status of said axial compressor is generated in case of said fouling parameter having a value lying beyond a predetermined value range.

16. Process for detecting fouling of an axial compressor, said compressor comprising a rotor, a housing, an inlet where, in operation, gas enters at a first pressure, and an outlet where, in operation, gas exits at a second pressure higher than said first pressure, said rotor being rotatably mounted within said housing for rotation about a rotational axis, said axial compressor further comprising at least one axial compressor stage, each said axial compressor stage comprising a row of rotor blades mounted on said rotor and being arranged one following the other in a circumferential direction with respect to said rotational axis, and a row of stator blades mounted on said housing and being arranged one following the other in a circumferential direction with respect to said rotational axis, each said axial compressor stage having, in operation, a dynamic pressure field surrounding each said rotor in the region of said housing, each said axial compressor stage further having, in operation, a characteristic frequency defined as the product of the number of rotor blades mounted in said row of rotor blades and the rotational speed of said rotor, each said axial compressor stage further having a defined threshold value parameter associated with said characteristic frequency, said process comprising the following steps:

measuring the pressure fluctuations of a plurality of said dynamic pressure fields with a pressure sensing means responsive at said characteristic frequency and generating a respective plurality of sensor signals;

deriving a plurality of frequency components from each sensor signal, wherein one said frequency component is derived at a frequency essentially equivalent to said characteristic frequency;

smoothing said plurality of frequency components into a complete frequency signal comprised of a plurality of smoothed frequency signals respective to said plurality of sensor signals; and integrating said complete frequency signal over a predetermined integration interval to determine an integral value;

comparing said integral value and said defined threshold value parameter, thereby determining a fouling parameter indicative of the fouling of said axial compressor.

17. Process according to claim 16, wherein said pressure sensing means is connected to said housing between the rotor blades and the stator blades of one of said axial compressor stages.

18. Process according to claim 16, wherein said at least one pressure sensing means is connected to said housing near the inlet of said axial compressor.

19. Process according to claim 16, wherein said pressure sensing means comprises a piezoelectric pressure sensor.

20. Process according to claim 16, wherein said plurality of frequency components are derived by fast Fourier transformation (FFT).

21. Process according to claim 16, wherein said plurality of frequency components are derived by fast Hartley transformation (FHT).

22. Process according to claim 16, wherein said integration interval is 0 to 20000 Hz.

23. Process according to claim 16, wherein said frequency interval equals said integration interval.

24. Process according to claim 16, wherein said fouling parameter is defined as the integral value divided by an operating parameter indicative of the operating condition.

25. Process according to claim 24, wherein said operating parameter is indicative of the power output of the axial compressor.

26. Process according to claim 16, wherein a status change signal indicative of a change of operational status of said axial compressor is generated in case of said fouling parameter having a value lying beyond a determined value range.

27. Computer implemented system for detecting fouling of an axial compressor, said axial compressor comprising a rotor, a housing, an inlet where, in operation, gas enters at a first pressure, and an outlet where, in operation, gas exits at a second pressure higher than said first pressure, said rotor being rotatably mounted within said housing for rotation about a rotational axis, said axial compressor further comprising at least one axial compressor stage, each said axial compressor stage comprising a row of rotor blades mounted on said rotor and being arranged one following the other in a circumferential direction with respect to said rotational axis, and a row of stator blades mounted on said housing and being arranged one following the other in a circumferential direction with respect to said rotational axis, each said axial compressor stage having, in operation, an associated dynamic pressure field surrounding each said rotor in the region of said housing, each said axial compressor stage further having, in operation, a characteristic frequency defined as the product of the number of rotor blades mounted in said row of rotor blades and the rotational speed of said rotor, each said axial compressor stage further having a defined reference pattern associated with said characteristic frequency, said computer implemented system comprising:

pressure sensing means responsive at said characteristic frequency to measure pressure fluctuations of at least one said dynamic pressure field and generate at least one sensor signal;

a transformation unit for deriving a plurality of frequency components from each sensor signal, wherein one said frequency component is derived at a frequency essentially equivalent to said characteristic frequency; and a computer subunit for smoothing said plurality of frequency components into a smoothed frequency signal and for comparing said smoothed frequency signal and said defined reference pattern to derive a fouling signal indicative of the fouling of said axial compressor.

28. Computer implemented System according to claim 27, wherein said pressure sensing means is connected to said housing between the rotor blades and the stator blades of one of said axial compressor stages.

29. Computer implemented system according to claim 27, wherein said pressure sensing means comprises a piezoelectric pressure sensor.

30. Computer implemented system according to claim 27, wherein said at least one pressure sensing means is connected to said housing near the inlet of said axial compressor.

31. Computer implemented system according to claim 27, wherein said transformation unit comprises a fast Fourier transformation unit.

32. Computer implemented system according to claim 27, wherein said transformation unit comprises a fast Hartley transformation unit (FHT).

33. Computer implemented system according to claim 27, further comprising a status indicating unit for receiving said fouling signal and being indicative thereof.

34. Computer implemented system for detecting fouling of an axial compressor, said axial compressor comprising a rotor, a housing, an inlet where, in operation, gas enters at a first pressure, and an outlet where, in operation, gas exits at a second pressure higher than said first pressure, said rotor being rotatably mounted within said housing for rotation about a rotational axis, said axial compressor further comprising at least one axial compressor stage, each said axial compressor stage comprising a row of rotor blades mounted on said rotor and being arranged one following the other in a circumferential direction with respect to said rotational axis, and a row of stator blades mounted on said housing and being arranged one following the other in a circumferential direction with respect to said rotational axis, each said axial compressor stage having, in operation, an associated dynamic pressure field surrounding each said rotor in the region of said housing, each said axial compressor stage further having, in operation, a characteristic frequency defined as the product of the number of rotor blades mounted in said row of rotor blades and the rotational speed of said rotor, each said axial compressor stage further having a defined reference pattern associated with said characteristic frequency, said computer implemented system comprising:

pressure sensing means responsive at said characteristic frequency for measuring pressure fluctuations of a plurality of said dynamic pressure fields with a pressure sensing means responsive at said characteristic frequency to generate a respective plurality of sensor signals;

a transformation unit for deriving a plurality of frequency components from each sensor signal wherein one said frequency component is derived at a frequency essentially equivalent to said characteristic frequency; and a computer subunit for smoothing said plurality of frequency components into a complete frequency signal comprised of a plurality of smoothed frequency signals respective to said plurality of sensor signals, integrating said complete frequency signal over a predetermined integration interval to determine an integral value, and comparing said integral value and said defined threshold value parameter to derive a fouling signal indicative of the fouling of said axial compressor.

35. Computer implemented system according to claim 34, wherein said pressure sensing means is connected to said housing between the rotor blades and the stator blades of one of said axial compressor stages.

36. Computer implemented system according to claim 34, wherein said pressure sensing means comprises a piezoelectric pressure sensor.

37. Computer implemented system according to claim 34, wherein said at least one pressure sensing means is connected to said housing near the inlet of said axial compressor.

38. Computer implemented system according to claim 34, wherein said transformation unit comprises a fast Fourier transformation unit.

39. Computer implemented system according to claim 34, wherein said transformation unit comprises a fast Hartley transformation unit (FHT).

40. Computer implemented system according to claim 34, further comprising a status indicating unit for receiving said fouling signal and being indicative thereof.

41. Process according to claim 1, wherein said pressure sensing means comprises a piezoresistive pressure sensor.

42. Process according to claim 16, wherein said pressure sensing means comprises a piezoresistive pressure sensor,

43. Computer implemented system according to claim 27, wherein said pressure sensing means comprises a piezoresistive pressure sensor.

44. Computer implemented system according to claim 34, wherein said pressure sensing means comprises a piezoresistive pressure sensor.

* * * * *